US008388474B1

(12) United States Patent
Griffith et al.

(10) Patent No.: US 8,388,474 B1
(45) Date of Patent: Mar. 5, 2013

(54) LOW PROFILE HELICAL ARROW VANE

(75) Inventors: Larry R. Griffith, Lake City, MI (US); Anne-Marie Bebak, The Woodlands, TX (US)

(73) Assignee: The Bohning Company, Ltd, Lake City, MI (US)

( * ) Notice: Subject to any disclaimer, the term of this patent is extended or adjusted under 35 U.S.C. 154(b) by 0 days.

(21) Appl. No.: 13/253,507

(22) Filed: Oct. 5, 2011

(51) Int. Cl.
*F42B 6/06* (2006.01)

(52) U.S. Cl. ..... 473/586

(58) Field of Classification Search ..... 473/578, 473/585, 586
See application file for complete search history.

(56) References Cited

U.S. PATENT DOCUMENTS 1,648,376 A * 11/1927 Blodgett ..... 269/38
3,749,403 A * 7/1973 Austin et al. ..... 473/586
7,914,406 B2 * 3/2011 Andrews ..... 473/586
8,025,596 B2 * 9/2011 Klein ..... 473/586

* cited by examiner

*Primary Examiner* — John Ricci
(74) *Attorney, Agent, or Firm* — Smith Risley Tempel Santos LLC; Gregory Scott Smith

(57) ABSTRACT

Disclosed is a vane that can be attached to an arrow shaft to provide substantial stabilization in arrow flight through increased drag and arrow shaft spin. Embodiments of the inventive vane do not significantly increase the weight of an arrow and/or create a high probability of clearance problems with bow components. The vane is approximately 3.997 inches long and 0.327 inches high including the base height. The vane fin is approximately 0.28 inches high. Some embodiments may have a length approximately 2.997 inches long. An advantage of some embodiments is that the vane may be applied to an arrow shaft in a helical fashion.

20 Claims, 4 Drawing Sheets

LOW PROFILE HELICAL ARROW VANE

BACKGROUND

The instant invention is generally directed to the field of archery and archery arrows and, more specifically, to the field of vane structures on archery arrows to control arrow flight.

An arrow with no vanes flies fast—however, it also flies erratically. To reduce erratic flight, archers necessarily sacrifice a certain amount of flight speed through the application of arrow vanes. Vanes, which may be constructed from natural feathers or synthetic materials, are typically mounted in a plurality arrangement, parallel to the aft end of an arrow shaft. Notably, at the expense of a little flight speed, the vanes produce a certain amount of lift and side force on the arrow which advantageously serves to stabilize its flight pattern by moving the center of pressure aftwards, thereby increasing shot accuracy.

Generally speaking, the more surface area offered in a given vane, the more lift and side force that it introduces. There is a limit, however, on the practicality of simply increasing vane size for improved shot accuracy. For instance, larger vanes have a higher probability of interfering with bow components, such as an arrow rest, as the arrow is released from a drawn bow. The interference inevitably destabilizes the arrow flight, thereby negating any stabilization advantage offered by the increased surface area of the larger vane.

For conventional vanes, it is important that the vanes are installed precisely on the arrow shaft. Otherwise, bias away from the intended flight path of the arrow can be introduced from undesirable lift and/or side forces. Such undesirable bias can be negated by intentionally introducing a spin motion to the flight of the arrow. One way that spin may be introduced to an arrow is through vanes that have been fixed to the aft end of the arrow in an offset relative to the longitudinal axis of the arrow. In this way, as the arrow is projected forward on a path substantially in line with the arrow axis, the broad surface area of the vanes receive a force from the passing air that is translated to the arrow shaft on a vector offset from the arrow's longitudinal axis (i.e., a rolling moment), thereby causing the arrow to spin as it flies forward.

Another way that spin may be introduced to an arrow is through the application of vanes having a pre-curled profile that somewhat resembles the shape of a sail filled with wind. These pre-curled vane types may also be applied on an offset relative to the longitudinal axis of an arrow, as explained above. Notably, however, a possible advantage of a pre-curled vane profile over a "flat" vane is that the pre-curled vane, because it is curved, is significantly less stiff in the radial direction, which may reduce the forces imparted on the arrow in the event of an accidental collision of the vane with bow components during arrow launch.

Whether a "flat" vane or a "pre-curled" vane is used to introduce arrow spin, the amount of aerodynamic stability is limited by the overall vane height that can be accommodated when the arrow is released from a drawn bow. Simply put, taller vanes, while providing increased stability, are more prone to interfering with bow components as the arrow is released from a draw. To mitigate the detrimental effects on flight pattern that results from interference with bow components, flat vanes and pre-curled vanes alike are often made of flexible material. Flexible materials, however, allow the vane to deflect in flight, potentially reducing the total rolling moment that can be produced.

Additionally, because introduction of spin necessitates that vanes known in the art be positioned on an offset relative to the longitudinal axis of the arrow, it is a problem that vanes may be stressed, deformed or "kinked" as they are manipulated to mount on a cylindrical arrow shaft. This negative aspect is true of both flat vanes and pre-curled vanes presently known in the art.

Therefore, what is needed in the art is an arrow vane that can leverage stiff, high strength materials of construction for efficient transfer of energy with minimal risk of interference with bow components. Moreover, what is needed in the art is an arrow vane that can be communicated with the cylindrical shaft of an arrow without detrimentally affecting the vane shape or profile.

These, as well as other needs in the art, are addressed in the various embodiments of the invention as presented herein.

BRIEF SUMMARY

The various embodiments, features and aspects of the present invention overcome and/or alleviate some of the short comings in the above-noted prior art. Embodiments include a vane for mounting to a projectile. The vane may include a base for mounting on the surface of the projectile. In some embodiments, the base may be configured specifically to relieve stresses often associated with mounting a vane along a helical path of the outer surface of a projectile.

The vane may also include a vane fin in communication with the base and configured to introduce lift and side forces when the projectile is launched. The vane fin may include a contour defined by a bottom-edge, a rear-edge and a front-edge, and have a length L and a height H with a ratio of L to H which, in an exemplary embodiment, is approximately 12 to 1. The bottom-edge of the vane fin may adjoin to the base and have a front point and a back point in common with the base. In an exemplary embodiment, the rear-edge may degrade along a first curve with an associated first radius from an upper point to a lower point, the lower point corresponding to the back point of the bottom-edge. Further, the front-edge may also have an upper point and a lower point, the upper point corresponding to the upper point of the back-edge. The front-edge may degrade from its upper point toward its lower point which corresponds with the front point of the bottom-edge.

In some embodiments, the front-edge degrades towards the front point of the bottom-edge along a second curve with an associated second radius to a transition point and then arcs concave to the bottom-edge downwardly from the transition point along a third curve having an associated third radius to the front point of the bottom-edge, thereby creating somewhat of a blunt "nose" at the front of the vane fin. In this way, the third radius of the front-edge is less than the second radius of the front-edge.

Advantages of various embodiments of the vane include (a) a low profile that significantly reduces potential contact with an arrow rest when an arrow is launched from a bow; (b) significant surface area useful for creating aerodynamic stability; (c) a center of pressure on par with higher profile vanes, including pre-curled vanes; (d) ease of helical mounting; (e) vane base configured to maximize contact with an arrow shaft and relieve stresses normally associated with helical mounting; and (f) suitability for relatively durable and stiff materials of construction.

The above-described and additional features may be considered, and will become apparent in conjunction with the drawings, in particular, and the detailed description which follow.

BRIEF DESCRIPTION OF THE SEVERAL VIEWS OF THE DRAWING

In the drawings, like reference numerals refer to like parts throughout the various views unless otherwise indicated. For reference numerals with letter character designations such as "102A" or "102B", the letter character designations may differentiate two like parts or elements present in the same figure. Letter character designations for reference numerals may be omitted when it is intended that a reference numeral to encompass all parts having the same reference numeral in all figures.

DETAILED DESCRIPTION

The present disclosure is directed towards providing a vane, as well as features and aspects thereof, which can be attached to an arrow shaft to provide substantial stabilization in arrow flight through increased lift and side forces and arrow shaft spin. Embodiments of the vane do not significantly increase the weight of an arrow and/or create a high probability of clearance problems with bow components.

An exemplary embodiment includes an arrow vane structure which, through its design characteristics and suitability with stiff, strong material selection, generally promotes arrow flight stability and shot accuracy while minimizing overall vane height. In general, embodiments of the invention include a primary vane member. In some embodiments, the vane member is substantially rigid to maintain its shape and position during arrow flight. Even so, embodiments are not limited to construction from substantially stiff material as it is envisioned that some embodiments may be constructed of resiliently bendable material, synthetic or otherwise, having a memory aspect that facilitates a return to an original shape after being bent due to an applied force. That is, although it is an advantage of some embodiments of the invention that a substantially rigid material may be effectively used, the particular material included in a given embodiment will not serve to limit the scope of the present disclosure.

Turning now to the figures in which like labels refer to like elements throughout the several views, various embodiments, aspects and features of the present invention are presented.

Figure 1A:
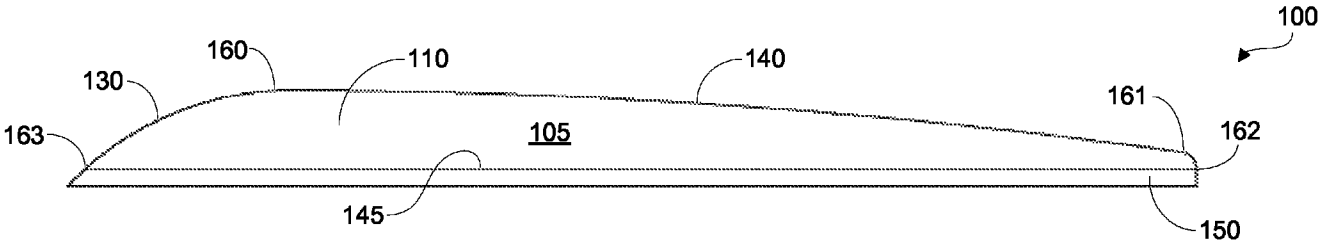
FIG. 1A is a side-profile diagram of an exemplary embodiment of a vane.

FIG. 1A is a side-profile diagram of an exemplary embodiment of a vane. The vane member 100 includes two main components, the vane fin 105 and the vane base 150. The vane fin 105 is a flat piece of material having a right-side planar surface 110 and a left-side planar surface 120 (not shown in this FIG. 1A). The shape of the vane fin 105 is defined by a back-edge or rear-edge 130, a front-edge 140 and a base edge 145. Traversing the contour of the vane fin 105, the back-edge 130 is an arc that extends upward from point 163 where it meets the base edge 145, to a point 160 (the top of the vane 100) where it meets the rearward end of the front-edge 140. The front-edge 140 then extends downward in a slightly curved fashion towards point 161 where it abruptly curves toward point 162 and terminates at the base edge 145. The based edge 145 extends from point 162 in a linear fashion to point 163.

Notably, although rear-edge 130 and front-edge 140 are described and depicted in the exemplary FIG. 1 embodiment to be comprised of concave curves, one of ordinary skill in the art will recognize that any or all of the edges of vane fin 105 may be altered to a substantially linear form, or convex curve, without necessarily departing from the scope of the invention. Moreover, one of ordinary skill in the art will recognize that not all embodiments will necessarily include a front-edge 140 that transitions from a first curve between points 160 and 161 to a second, more abrupt, curve between points 161 and 162. That is, it is envisioned that the front-edge 140 of some embodiments may continue from point 160 to point 162 on a single curve defined by a certain radius.

Figure 1B:
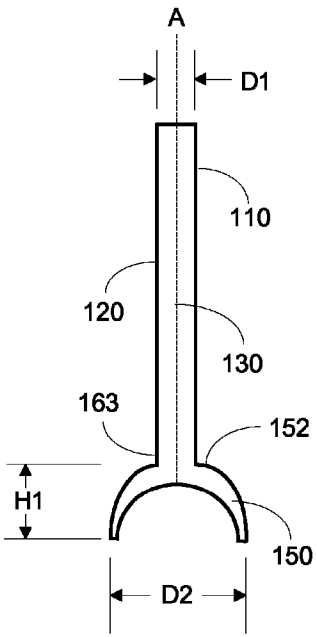
FIGS. 1B-1C are rear-profile and front-profile diagrams, respectively, of the embodiment illustrated in FIG. 1.
Figure 1C:
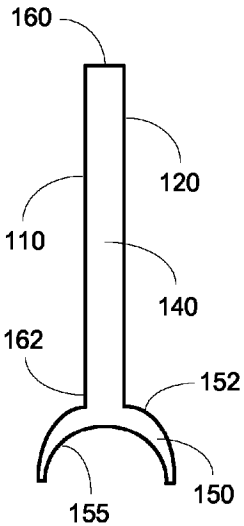

FIGS. 1B-1C are rear-profile and front-profile diagrams, respectively, of the embodiment illustrated in FIG. 1. As shown in FIGS. 1B-1C, the right-side planar surface 110 and the left-side planar surface 120 are spaced apart by a width D1 to form the back-edge 130, front-edge 140 and base-edge 145. Notably, although the width D1 of the illustrative embodiment is depicted as remaining constant throughout the height of vane fin 105 from base edge 145 to top point 160, it is envisioned that some embodiments may have a width measurement proximate to base edge 145 that is increased over a width measurement taken proximate to top point 160. In an exemplary embodiment, the width D1 is approximately 0.028 inches, however, it will be appreciated that other widths for D1 are envisioned for other embodiments and, as such, a particular value or range of values for D1 (although perhaps novel in and of itself) will not limit the scope of the invention.

The base 150 is substantially perpendicular to the vane fin 105 and has a top surface 152 and a bottom surface 155. The top surface 152 of the base 150 is attached, adhered, adjoined, integral with or otherwise meets or corresponds with the bottom-edge 145 of the vane fin 105. The bottom surface of the base 150 is attachable to the surface of an arrow shaft or, in some embodiments, may be attachable or integral to an arrow wrap component configured to securely wrap around an arrow shaft.

In some embodiments, the base 150 may be substantially box-shaped with the top surface and the bottom surface being two substantially parallel and flat surfaces, joined together by four edges that are substantially perpendicular to the top surface and the bottom surface to form the box. In other embodiments, the bottom surface may be arched to correspond with the cylindrical surface of the arrow shaft to which it will be attached. In yet other embodiments, such as the exemplary embodiment depicted in FIGS. 1B-1C, the entire base 150 may be curved in accordance with the arrow shaft. Although the present invention is not limited to any particular structure for the base 150, it will be appreciated that the embodiments presented herein, such as but not limited to the embodiment described below relative to FIG. 3, may in and of themselves be considered novel aspects or features of various novel embodiments. Although the base 150 is described as mounting to the surface of an object, it will be appreciated that the base could also be embedded in a slot of the surface or a recess, welded to the shaft, molded into the shaft or otherwise integral with the shaft.

The base 150, in an exemplary embodiment of the invention, is larger than the width of the vane fin 105. In some embodiments, the width D2 of the base 150 is approximately 0.140 inches, although other widths are envisioned for accommodation of various shaft sizes used in the art and, as such, the particular width D2 will not limit the scope of the disclosure. The illustrated base 150 is positioned relative to an axis extending through the vane fin 105 from the base-edge 145 up through the top of the vane 160 as illustrated by the dotted line A. In an exemplary embodiment, the height H1 of the base 150 from the point 163 to the bottom is approximately 0.051 inches.

Figure 2A:
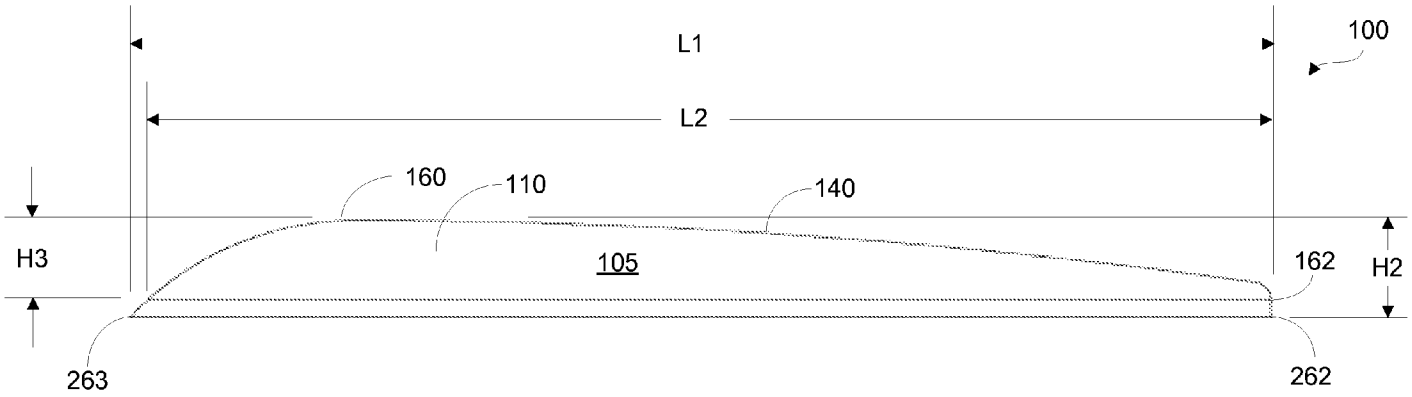
FIGS. 2A-2B are side-profile diagrams of an embodiment of a vane and identifying particular dimensions and dimension ranges.
Figure 2B:
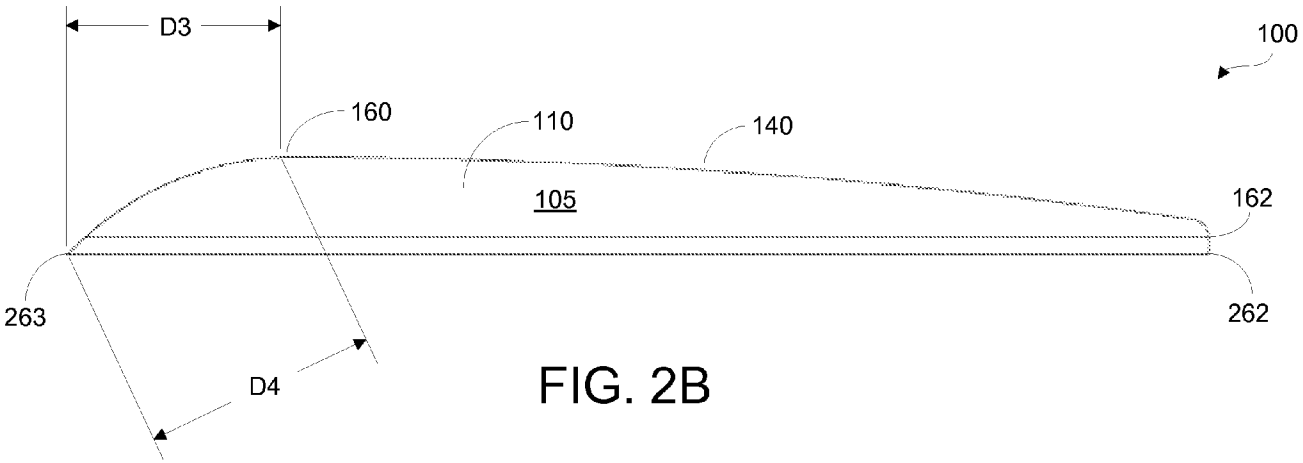

FIGS. 2A-2B are side-profile diagrams of an exemplary embodiment of a vane and identifying particular dimensions and dimension ranges. The length L1 of the vane 100 is the distance from point 262 to point 263. The length L2 of the vane fin 105 is the distance from point 162 to point 163 and basically is the length of the bottom-edge 145. It will be appreciated that although the length L1 of the base 150 is illustrated and described as being longer than the length L2 of the vane fin 105, it is envisioned that in some embodiments the base 150 may be shorter than the bottom-edge 145 (L1<L2) or the base 150 may be the same length as the base-edge 145 (L1=L2) and as such, the present invention is not limited to any particular relationship, although the various relationships may be considered as novel aspects of the present invention. Thus, in some embodiments, the length L1 is the length of the vane 100, whereas in other embodiments, the length L2 is the length of the vane 100, and yet in other embodiments, the lengths L1 and L2 are equal and represent the length of the vane 100.

In the illustrated embodiment, the bottom-edge 145, and hence, the length of the vane fin 105, is slightly shorter than the length of the base 150, or in this case the length of the vane 100. In an exemplary embodiment, the value of L1 is 3.997 inches±0.005 inches, although it is envisioned that the length L1 may be any length without departing from the scope of the disclosure. For instance, it is envisioned that some embodiments may have an L1 of 2.997 inches±0.005 inches. It is further envisioned that other embodiments may have an L1 of 1.9997 inches±0.005 inches.

The height of the vane 100 from the bottom surface of the base 150 to the top of the vane 160 is H2 and the height of the vane fin 105 from the bottom-edge 145 to the top of the vane 160 is H3. In an exemplary embodiment, H2 is 0.327 inches±0.005 inches and H3 is 0.276±0.005 inches. Thus, in the illustrated embodiment which depicts an L1 of 3.997 inches±0.005 inches, the ratio of the length of the vane to the height of the vane is approximately 12:1. Notably, one of ordinary skill in the art will recognize that the ratio of the length of the vane to the height of the vane will change in embodiments having different lengths of L1. For example, in an embodiment having an L1 of 2.997 inches±0.005 inches, the ratio of the length of the vane to the height of the vane is approximately 9:1.

The front-edge 140 is an arc extending from point 161 to point 160 and opening towards the bottom-edge 145 of the vane fin 105. In an exemplary embodiment, the radius of the front-edge arc is approximately 19.807±0.005 radians. Notably, it is envisioned that the radius of the arc of front-edge 140 may be more or less than 19.807±0.005 radians, if arced at all, and, as such, the specific radius associated with front-edge 140 is not a limiting factor for the scope of the disclosure.

Similarly, the back-edge 130 is an arc extending from point 163 to point 160 opening towards the bottom-edge 145 of the vane fin 105. In an exemplary embodiment, the radius of the back-edge arc is approximately 1.087±0.005 radians. Notably, it is envisioned that the radius of the arc of back-edge 130 may be more or less than 1.087±0.005 radians, if arced at all, and, as such, the specific radius associated with back-edge 130 is not a limiting factor for the scope of the disclosure.

In the exemplary embodiment, the horizontal distance D3 from top point 160 to point 163 is approximately 0.747±0.005 inches. In addition, the geometric chord D4 from point 163 to top point 160 is approximately 0.813±0.005 inches. Notably, one of ordinary skill in the art will recognize that the lengths of D3 and D4 will vary across embodiments of the invention.

Figure 3:
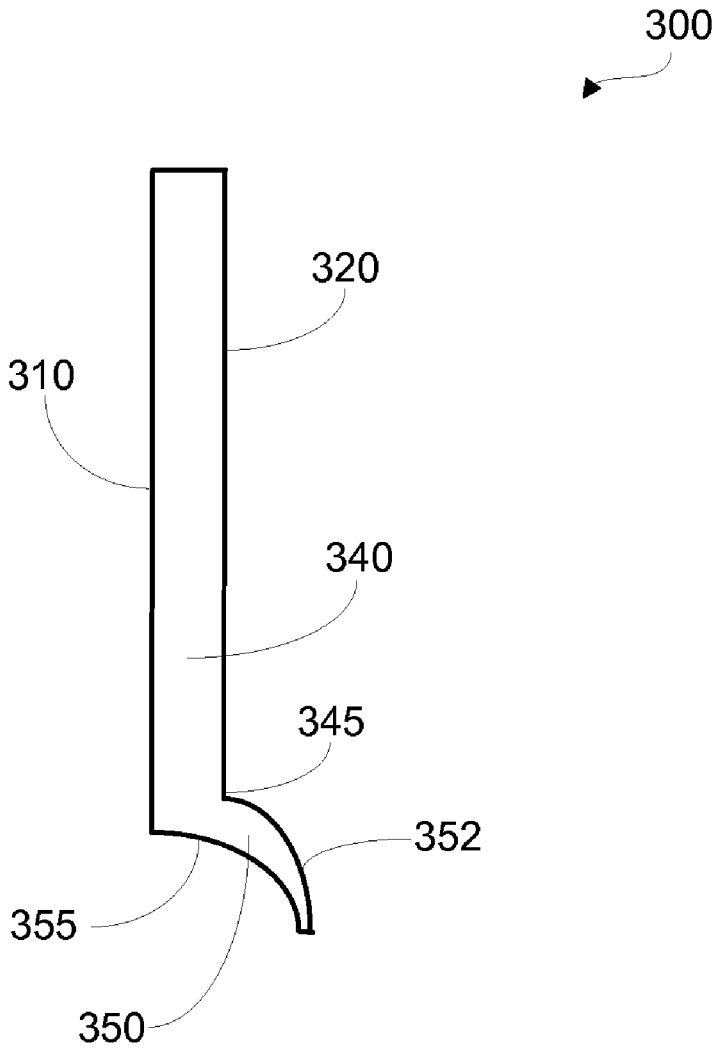
FIG. 3 illustrates a front-profile diagram of another embodiment of the vane having a one-sided base.

Turning now to FIG. 3, a front-profile diagram of an exemplary embodiment 300 having a one-sided base 350 is depicted. As shown in FIG. 3, the right-side planar surface 310 and the left-side planar surface 320 are spaced apart to form the back-edge (not shown), front-edge 340 and bottom-edge 345.

Similar to that which has been described relative to the exemplary FIG. 1 embodiment, the base 350 is substantially perpendicular to the vane fin and has a top surface 352 and a bottom surface 355. The top surface 352 of the base 350 is attached, adhered, adjoined, integral with or otherwise meets or corresponds with the bottom-edge 345 of the vane fin. The bottom surface 355 of the base 350 is attachable to the surface of an arrow shaft or, in some embodiments, may be attachable or integral to an arrow wrap component configured to securely wrap around an arrow shaft.

It is an advantage of the FIG. 3 embodiment that the vane 300 may be positioned along the surface of an arrow shaft in a helical fashion without significantly distorting, stressing, deforming or "kinking" the vane 300. That is, one of ordinary skill in the art will recognize that the FIG. 3 embodiment may be positioned along a line that is at first offset from the longitudinal axis of an arrow shaft and then wrapped around the shaft such that the one-sided base 350 translates along the outside, longer edge of a portion of a helical path. It is envisioned that, in some embodiments, the portion of the helical path may extend 122°±5° around the shaft of an arrow, although other helical path portions are envisioned. Moreover, one of ordinary skill in the art will recognize that a given embodiment of the inventive vane will extend further around the shaft of a first arrow having a cross-sectional diameter that is less than that of a second, larger arrow. As such, the range of the helical path portion utilized by a given embodiment of the inventive vane is application specific and will not serve to limit the scope of the disclosure.

Notably, because the base 350 of the FIG. 3 embodiment only includes a leg on one side of the vane 300, one of ordinary skill in the art will recognize that a "relief" is provided on the opposite side such that the vane 300 may be spiraled around a shaft without causing deformation to the vane fin or base 350. Advantageously, because the base 350 is not distorted or "kinked" in order to mate with the surface of an arrow shaft along a helical path, consistent contact between the bottom surface 355 and the arrow shaft may be realized over other embodiments.

Figure 4B:
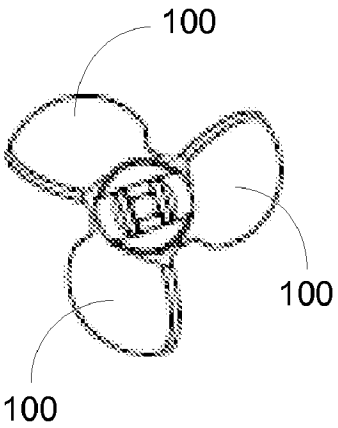
FIG. 4B is a rear view of the arrow shaft and plurality of helically mounted vanes depicted in FIG. 4A.
Figure 4A:
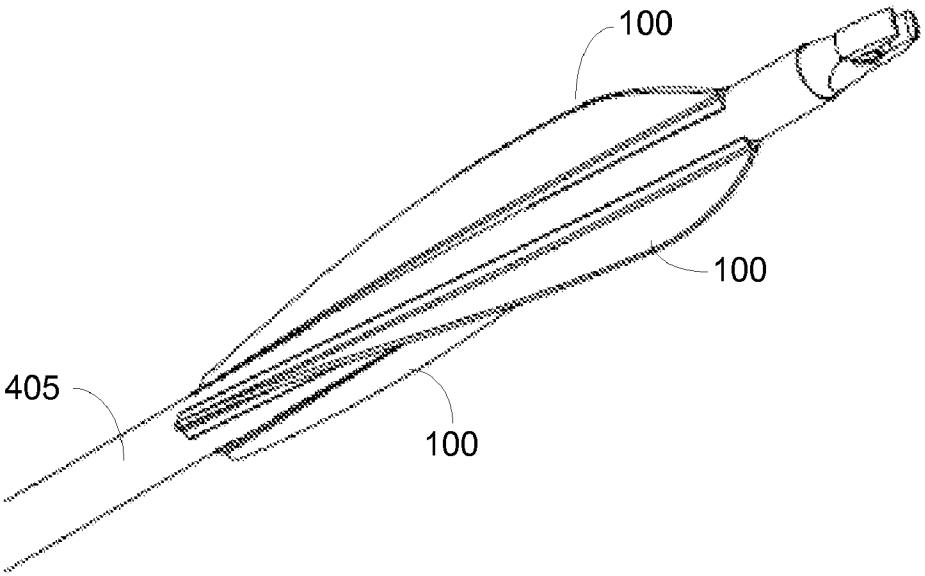
FIG. 4A is a perspective drawing of a plurality of vanes according to an exemplary embodiment of the present invention, shown mounted to an arrow shaft along complimentary helical paths.

FIG. 4A is a perspective drawing of a plurality of vanes according to an exemplary embodiment of the present invention, shown mounted to an arrow shaft 405 along complimentary helical paths. Notably, as one of ordinary skill in the art would recognize from the depiction of a nock 410, the vanes 100 are mounted to the aft end of the arrow shaft 405. The plurality of vanes 100 are represented in a numerical combination of three, although a greater number of vanes may be used and even lesser vanes can be used depending on the embodiment or use of the vane.

FIG. 4B is a rear view of the arrow shaft 405 and plurality of helically mounted vanes 100 depicted in FIG. 4A.

It should be appreciated that the various embodiments of the described vane can be attached to a variety of objects or projectiles and although the embodiments have primarily been described as being affixed to an arrow, they may also be affixed to other projectiles, such as darts, lawn darts, spears, javelins, model airplanes, toy rockets, crossbow bolts or the like. Further, embodiments of the invention may be constructed of any material which provides a substantially rigid contour during arrow flight. Plastics or other synthetic materials are among included possible materials. The material may be resiliently bendable, such that, if outside force causes it to alter shape, it will return to its original contour. In other embodiments, the material may be rigid. In some embodiments, the material may be hollow or include hollowed out sections to reduce the weight.

One of ordinary skill in the art will recognize that embodiments of the present invention, due to the high ratio of length to height, may provide less probability of interference with bow components as an arrow is launched. As such, it is an advantage of the present invention that stiffer materials of construction may be selected without concern for unforgiving interference with bow components. In turn, stiffer and stronger material selection may provide for more effective rotational forces on the arrow (i.e., arrow spin). Similarly, the suitability for application along a helical path of the arrow shaft surface provides for increased introduction of lift and side forces without a vane height that can interfere with bow components.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A vane for mounting to a projectile, the vane comprising:
a base for mounting on the surface of the projectile; and
a vane fin including a contour defined by a bottom-edge, a rear-edge and a front-edge, and having a length L and a Height H with a ratio of L to H being approximately 12 to 1, wherein:
the bottom-edge has a front point and a back point and is substantially linear between these points and is adjoined to the base;
the rear-edge degrades along a first curve with an associated first radius from an upper point to a lower point, the lower point corresponds to the back point of the bottom-edge; and
the front-edge has an upper point and a lower point, the upper point of the front-edge corresponds to the upper point of the back-edge, and degrades from the upper point of the front-edge toward the lower point of the front edge which corresponds with the front point of the bottom-edge;
wherein the front-edge degrades towards the front point of the bottom-edge along a second curve with an associated second radius to a transition point and then arcs concave to the bottom-edge downwardly from the transition point along a third curve having an associated third radius to the front point of the bottom-edge;
wherein the third radius of the front-edge is less than the second radius of the front-edge.

2. The vane of claim 1, wherein the height of the vane fin H is 0.276 inches±0.005 inches.

3. The vane of claim 1, wherein the length of the vane L is 3.997 inches±0.005 inches.

4. The vane of claim 1, wherein the height of the vane H is 0.276 inches±0.005 inches and the length of the vane L is 3.997 inches±0.005 inches.

5. The vane of claim 1, wherein the first radius is 1.087 radians±0.005 radians.

6. The vane of claim 1, wherein the second radius is 19.807 radians±0.005 radians.

7. The vane of claim 1, wherein the base for mounting on the surface of the projectile comprises a single leg extending along the length of one side of the vane.

8. A vane for mounting to a projectile, the vane comprising:
a base for mounting on the surface of the projectile; and
a vane fin including a contour defined by a bottom-edge, a rear-edge and a front-edge, and having a length L and a Height H with a ratio of L to H being approximately 9 to 1, wherein:
the bottom-edge has a front point and a back point and is substantially linear between these points and is adjoined to the base;
the rear-edge degrades along a first curve with an associated first radius from an upper point to a lower point, the lower point corresponds to the back point of the bottom-edge; and
the front-edge has an upper point and a lower point, the upper point of the front-edge corresponds to the upper point of the back-edge, and degrades from the upper point of the front-edge toward the lower point of the front edge which corresponds with the front point of the bottom-edge;
wherein the front-edge degrades towards the front point of the bottom-edge along a second curve with an associated second radius to a transition point and then arcs concave to the bottom-edge downwardly from the transition point along a third curve having an associated third radius to the front point of the bottom-edge;
wherein the third radius of the front-edge is less than the second radius of the front-edge.

9. The vane of claim 8, wherein the height of the vane fin H is 0.276 inches±0.005 inches.

10. The vane of claim 8, wherein the length of the vane L is 2.997 inches±0.005 inches.

11. The vane of claim 8, wherein the height of the vane H is 0.276 inches±0.005 inches and the length of the vane L is 2.997 inches±0.005 inches.

12. The vane of claim 8, wherein the first radius is 1.087 radians±0.005 radians.

13. The vane of claim 8, wherein the second radius is 19.807 radians±0.005 radians.

14. The vane of claim 8, wherein the base for mounting on the surface of the projectile comprises a single leg extending along the length of one side of the vane.

15. A projectile including a plurality of vanes, wherein each of the plurality of vanes is positioned at the aft end of the projectile and extends around the projectile along a portion of a helical path, each of the plurality of vanes comprising:
a base for mounting on the surface of the projectile; and a vane fin including a contour defined by a bottom-edge, a rear-edge and a front-edge, and having a length L and a Height H with a ratio of L to H being approximately 12 to 1, wherein:

the bottom-edge has a front point and a back point and is substantially linear between these points and is adjoined to the base;

the rear-edge degrades along a first curve with an associated first radius from an upper point to a lower point, the lower point corresponds to the back point of the bottom-edge; and the front-edge has an upper point and a lower point, the upper point of the front-edge corresponds to the upper point of the back-edge, and degrades from the upper point of the front-edge toward the lower point of the front edge which corresponds with the front point of the bottom-edge;

wherein the front-edge degrades towards the front point of the bottom-edge along a second curve with an associated second radius to a transition point and then arcs concave to the bottom-edge downwardly from the transition point along a third curve having an associated third radius to the front point of the bottom-edge;

wherein the third radius of the front-edge is less than the second radius of the front-edge.

16. The projectile of claim 15, wherein the height of the vane fin H is 0.276 inches±0.005 inches.

17. The projectile of claim 15, wherein the length of the vane L is 3.997 inches±0.005 inches.

18. The projectile of claim 15, wherein the first radius is 1.087 radians±0.005 radians.

19. The projectile of claim 15, wherein the second radius is 19.807 radians±0.005 radians.

20. The projectile of claim 15, wherein the base for mounting on the surface of the projectile comprises a single leg extending along the length of one side of the vane.

* * * * *